US010900113B2

(12) United States Patent
Shingaki et al.

(10) Patent No.: US 10,900,113 B2
(45) Date of Patent: Jan. 26, 2021

(54) METHOD FOR MANUFACTURING GRAIN-ORIENTED ELECTRICAL STEEL SHEET, AND NITRIDING APPARATUS

(71) Applicant: JFE STEEL CORPORATION, Tokyo (JP)

(72) Inventors: Yukihiro Shingaki, Tokyo (JP); Hirotaka Inoue, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 405 days.

(21) Appl. No.: 15/502,259

(22) PCT Filed: Sep. 4, 2015

(86) PCT No.: PCT/JP2015/004503
§ 371 (c)(1),
(2) Date: Feb. 7, 2017

(87) PCT Pub. No.: WO2016/035345
PCT Pub. Date: Mar. 10, 2016

(65) Prior Publication Data

US 2017/0226622 A1 Aug. 10, 2017

(30) Foreign Application Priority Data

Sep. 4, 2014 (JP) ..... 2014-180300

(51) Int. Cl.

| | |
|---|---|
| ***H01F 1/16*** | (2006.01) |
| ***C23C 8/26*** | (2006.01) |
| ***C21D 9/46*** | (2006.01) |
| ***C23C 8/02*** | (2006.01) |
| ***C22C 38/60*** | (2006.01) |
| ***C22C 38/00*** | (2006.01) |
| ***C21D 8/12*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/28*** | (2006.01) |
| ***C22C 38/34*** | (2006.01) |
| ***C23F 17/00*** | (2006.01) |
| *F27D 7/02* | (2006.01) |
| *F27B 9/04* | (2006.01) |
| *F27D 7/06* | (2006.01) |

(52) U.S. Cl.

CPC ..... *C23C 8/26* (2013.01); *C21D 8/12* (2013.01); *C21D 8/1222* (2013.01); *C21D 8/1233* (2013.01); *C21D 8/1272* (2013.01); *C21D 8/1277* (2013.01); *C21D 9/46* (2013.01); *C22C 38/00* (2013.01); *C22C 38/002* (2013.01); *C22C 38/008* (2013.01); *C22C 38/04* (2013.01); *C22C 38/06* (2013.01); *C22C 38/08* (2013.01); *C22C 38/12* (2013.01); *C22C 38/16* (2013.01); *C22C 38/28* (2013.01); *C22C 38/34* (2013.01); *C22C 38/60* (2013.01); *C23C 8/02* (2013.01); *C23F 17/00* (2013.01); *H01F 1/16* (2013.01); *F27B 9/045* (2013.01); *F27D 7/02* (2013.01); *F27D 7/06* (2013.01)

(58) Field of Classification Search

CPC ..... C23C 8/26; C23C 8/02; C21D 8/1277; C21D 8/1222; C21D 8/1233; C21D 8/1272; C21D 8/12; C21D 9/46; C22C 38/34; C22C 38/04; C22C 38/00; C23F 17/00; H01F 1/16; F27D 7/06; F27B 9/045

See application file for complete search history.

(56) References Cited

U.S. PATENT DOCUMENTS

| | | | |
|---|---|---|---|
| 1,965,559 A | 7/1934 | Goss | |
| 3,932,234 A | 1/1976 | Imanaka et al. | |
| 4,979,996 A | 12/1990 | Kobayashi et al. | |
| 4,979,997 A | 12/1990 | Kobayashi et al. | |
| 5,114,500 A | 5/1992 | Tahara et al. | |
| 5,192,485 A | 3/1993 | Kuramoto et al. | |

(Continued)

FOREIGN PATENT DOCUMENTS

| | | | | |
|---|---|---|---|---|
| CN | 102650014 | * | 8/2012 | ..... C21D 1/26 |
| CN | 102650014 A | | 8/2012 | |

(Continued)

OTHER PUBLICATIONS

Apr. 30, 2018, Communication pursuant to Article 94(3) EPC issued by the European Patent Office in the corresponding European Patent Application No. 15838971.8.

Aug. 6, 2018, Office Action issued by the Korean Intellectual Property Office in the corresponding Korean Patent Application No. 10-2017-7005887 with English language concise statement of relevance.

Jul. 25, 2018, Office Action issued by the State Intellectual Property Office in the corresponding Chinese Patent Application No. 201580047460.2 with English language concise statement of relevance.

(Continued)

*Primary Examiner* — Jophy S. Koshy
(74) *Attorney, Agent, or Firm* — Kenja IP Law PC

(57) ABSTRACT

In a grain-oriented electrical steel sheet manufacturing process of processing a steel slab having a predetermined composition to a final sheet thickness and then performing primary recrystallization annealing and nitriding treatment, the nitriding treatment is performed in at least two stages of temperatures including high-temperature nitriding and low-temperature nitriding, and a residence time in the high-temperature nitriding is 3 seconds or more and 600 seconds or less. In this way, nitrogen is efficiently diffused into the steel of the steel sheet before secondary recrystallization to precipitate AlN. Such a method can manufacture a grain-oriented electrical steel sheet having excellent magnetic property.

8 Claims, 2 Drawing Sheets

(56) References Cited

U.S. PATENT DOCUMENTS

| | | | | |
|---|---|---|---|---|
| 5,833,768 | A * | 11/1998 | Kosuge | C21D 3/04 148/111 |
| 6,406,557 | B1 | 6/2002 | Fortunati et al. | |
| 6,488,784 | B1 | 12/2002 | Fortunati et al. | |
| 8,277,573 | B2 * | 10/2012 | Abbruzzese | C22C 38/02 148/111 |
| 2004/0063058 | A1 | 4/2004 | Btu Int et al. | |
| 2012/0312423 | A1 | 12/2012 | Murakami et al. | |
| 2012/0312424 | A1 | 12/2012 | Murakami et al. | |
| 2013/0306202 | A1 | 11/2013 | Joo et al. | |
| 2015/0318094 | A1 | 11/2015 | Shingaki et al. | |
| 2016/0020006 | A1 | 1/2016 | Watanabe et al. | |

FOREIGN PATENT DOCUMENTS

| | | | | |
|---|---|---|---|---|
| CN | 102762751 | A | 10/2012 | |
| CN | 103429775 | A | 12/2013 | |
| EP | 1589120 | A1 | 10/2005 | |
| JP | S4015644 | B | 7/1965 | |
| JP | S5113469 | B2 | 4/1976 | |
| JP | H04183818 | * | 6/1992 | C21D 8/12 |
| JP | H04183818 | A | 6/1992 | |
| JP | H05320769 | A | 12/1993 | |
| JP | H06172939 | A | 6/1994 | |
| JP | H07197129 | A | 8/1995 | |
| JP | 2782086 | B2 | 7/1998 | |
| JP | 2000282142 | A | 10/2000 | |
| JP | 3311021 | B2 | 8/2002 | |
| JP | 2014152393 | A | 8/2014 | |
| KR | 100561140 | B1 | 3/2006 | |
| WO | 2006061903 | A1 | 6/2006 | |
| WO | 2011102455 | A1 | 8/2011 | |
| WO | 2011102456 | A1 | 8/2011 | |
| WO | 2014104394 | A1 | 7/2014 | |
| WO | 2014126089 | A1 | 8/2014 | |

OTHER PUBLICATIONS

Jul. 11, 2017, Extended European Search Report issued by the European Patent Office in the corresponding European Patent Application No. 15838971.8.

Tomoji Kumano et al., "Effect of Nitriding on Grain Oriented Silicon Steel Bearing AL", Jan. 3, 2005, Retrieved from the Internet: URL: https://www.jstage.jst.go.jp/article/isijinternational/45/1/45_1_95/_pdf [retrieved on Jun. 20, 2017].

Dec. 8, 2015, International Search Report issued in the International Patent Application No. PCT/JP2015/004503.

Y. Ushigami et.al: Mat. Sci. Forum, vols. 204-206, (1996), pp. 593-598.

Nov. 16, 2017, Office Action issued by the State Intellectual Property Office in the corresponding Chinese Patent Application No. 201580047460.2 with English language Search Report.

* cited by examiner

METHOD FOR MANUFACTURING GRAIN-ORIENTED ELECTRICAL STEEL SHEET, AND NITRIDING APPARATUS

TECHNICAL FIELD

The disclosure relates to a method for manufacturing a grain-oriented electrical steel sheet by which a grain-oriented electrical steel sheet having excellent magnetic property can be obtained at low cost, and a nitriding apparatus used in the method.

BACKGROUND

A grain-oriented electrical steel sheet is a soft magnetic material mainly used as an iron core material of a transformer, and has crystal texture in which <001> orientation which is the easy magnetization axis of iron is highly accumulated into the rolling direction of the steel sheet. Such texture is formed through secondary recrystallization of preferentially causing the growth of giant crystal grains in [110]<001> orientation which is called Goss orientation, when secondary recrystallization annealing is performed in the process of manufacturing the grain-oriented electrical steel sheet.

A conventional procedure for manufacturing such a grain-oriented electrical steel sheet is as follows.

A slab containing about 4.5 mass % or less Si and an inhibitor component such as MnS, MnSe, and MN is heated to 1300° C. or more to dissolve the inhibitor component. The slab in which the inhibitor component has been dissolved is then hot rolled, hot band annealed if required, and cold rolled once or twice or more with intermediate annealing in between, to a final sheet thickness.

The cold rolled sheet with the final sheet thickness is subjected to primary recrystallization annealing in a wet hydrogen atmosphere, to perform primary recrystallization and decarburization. An annealing separator having magnesia (MgO) as a base compound is applied to the cold rolled sheet which has undergone primary recrystallization and decarburization, and then final annealing is performed at 1200° C. for about 5 h to develop secondary recrystallization and purify the inhibitor component (for example, see U.S. Pat. No. 1,965,559 A (PTL 1), JP S40-15644 B2 (PTL 2), and JP S51-13469 B2 (PTL 3)).

Thus, high-temperature slab heating exceeding 1300° C. is necessary in the conventional grain-oriented electrical steel sheet manufacturing process, which requires very high manufacturing cost. The conventional process therefore has a problem of being unable to meet the recent demands to reduce manufacturing costs.

To solve such a problem, for example, JP 2782086 B2 (PTL 4) proposes a method of, while limiting slab heating to low temperature, containing 0.010% to 0.060% acid-soluble Al (sol.Al) and performing nitriding in an appropriate nitriding atmosphere in the decarburization annealing step so that (Al, Si)N is precipitated during secondary recrystallization and used as an inhibitor.

Here, (Al, Si)N disperses finely in the steel, and effectively functions as an inhibitor.

According to Y. Ushigami et.al: Mat. Sci. Forum, Vols. 204-206, (1996), pp. 593-598 (NPL 1), this is explained as follows.

In the aforementioned conventional method for manufacturing a grain-oriented electrical steel sheet, a precipitate ($Si_3N_4$ or (Si, Mn)N) mainly containing silicon nitride has been formed near the surface of the nitrided steel sheet. In secondary recrystallization annealing which follows, the precipitate mainly containing silicon nitride changes to an Al-containing nitride ((Al, Si)N or AlN) which is thermodynamically more stable. Here, $Si_3N_4$ present near the surface dissolves during heating in the secondary recrystallization annealing, and nitrogen diffuses into the steel. When the temperature exceeds 900° C. in the secondary recrystallization annealing, an Al-containing nitride approximately uniform in the sheet thickness direction precipitates, with it being possible to obtain grain growth inhibiting capability (inhibition effect) throughout the sheet thickness. This technique is advantageous in that the amount and grain size of precipitate uniform in the sheet thickness direction can be achieved relatively easily as compared with the precipitate dispersion control using high-temperature slab heating.

Techniques of changing the nitriding temperature to realize texture suitable for secondary recrystallization have been proposed, too. For example, WO 2011/102455 A1 (PTL 5) proposes a technique of performing recrystallization at a slightly lower temperature in a nitriding atmosphere and then performing nitriding at a higher temperature. This technique aims to inhibit the grain growth of primary recrystallized grains in the raw material before nitriding, thus appropriately controlling the primary recrystallized grain size and realizing texture suitable for secondary recrystallization.

WO 2011/102456 A1 (PTL 6) proposes a method of performing only primary recrystallization at a slightly higher temperature and then performing nitriding at a lower temperature. With this method, nitrogen can be distributed uniformly in the sheet thickness direction. In both PTL 5 and PTL 6, Ti and Cu are essential elements, which are added in order to obtain favorable property by uniformly precipitating the nitride after nitriding.

A factor that is as important as the inhibitor dispersion state in improving the property of the grain-oriented electrical steel sheet is the control of the texture in the primary recrystallization.

In the grain-oriented electrical steel sheet manufacturing process, the texture inherits the features of the texture from the previous step. In detail, texture that starts from columnar crystals or equiaxial crystals which are the crystalline form in the slab tends to become such texture that differs in the sheet thickness direction in the hot rolling stage, including a near-surface portion subjected to shear deformation by roll friction and a center portion subjected to simple compressive deformation.

Especially the surface of the steel sheet undergoes strong shear stress by friction with the rolls in the hot rolling and cold rolling steps, as a result of which randomized texture may be formed. Hence, in the case where secondary recrystallization develops from the surface of the steel sheet, favorable magnetic property may be unable to be obtained because the features of the texture subjected to shear deformation by roll friction are inherited.

CITATION LIST

Patent Literature

PTL 1: U.S. Pat. No. 1,965,559 A
PTL 2: JP S40-15644 B2
PTL 3: JP S51-13469 B2
PTL 4: JP 2782086 B2
PTL 5: WO 2011/102455 A1
PTL 6: WO 2011/102456 A1

Non-Patent Literature

NPL 1: Y. Ushigami et.al: Mat. Sci. Forum, Vols. 204-206, (1996), pp. 593-598

SUMMARY

Technical Problem

As described above, the conventionally proposed methods for manufacturing grain-oriented electrical steel sheets have difficulty in forming texture uniform in the sheet thickness direction. Especially in the case where secondary recrystallization develops from the texture of the surface of the steel sheet, the orientation tends to deviate from ideal [110]<001> orientation. Favorable magnetic property cannot be obtained with such texture whose orientation deviates from [110] <001> orientation.

It could therefore be helpful to provide a method for manufacturing a grain-oriented electrical steel sheet that provides a grain-oriented electrical steel sheet having excellent magnetic property by controlling the precipitation of AlN in steel to form texture uniform in the sheet thickness direction and cause secondary recrystallization with favorable orientation to develop in the steel sheet, and a nitriding apparatus suitable for use in the method.

Solution to Problem

We made the following assumption.

Rather than uniformly precipitating a nitride in the sheet thickness direction of the steel sheet to exhibit the inhibition effect, the nitride is precipitated more in the surface of the steel sheet. If secondary recrystallization is prevented from developing from the texture in the surface of the steel sheet by imparting stronger grain growth inhibiting capability to the surface of the steel sheet than the center portion in this way, the property of the steel sheet may be stabilized.

We then looked at the nitriding temperature. Nitrides each have a temperature suitable for precipitation. For example, it is known that about 900° C. is suitable for AlN to precipitate, about 700° C. is suitable for $Si_3N_4$ to precipitate, and about 500° C. is suitable for iron nitride to precipitate.

A grain-oriented electrical steel sheet is often nitrided at about 750° C., as this temperature is suitable for the precipitation of $Si_3N_4$. NPL 1 describes the precipitation of $Si_3N_4$ in the nitrided steel sheet.

In this case, however, the precipitation of $Si_3N_4$ is not uniform in the sheet thickness direction, and $Si_3N_4$ precipitates most near the surface of the steel sheet and nearly all of $Si_3N_4$ are present between the surface and the ¼ thickness. Thus, if the steel sheet is nitrided at the temperature suitable for the precipitation of $Si_3N_4$, the precipitation of $Si_3N_4$ starts immediately after nitrogen enters into the steel sheet by the nitriding, so that nitrogen cannot be sufficiently distributed to the center portion of the steel sheet.

In view of this, we first considered nitriding the steel sheet at the temperature suitable for the precipitation of AlN.

However, in the case where AlN precipitates only near the surface of the steel sheet, nitrogen does not diffuse to the center layer of the steel sheet, resulting in a state where no nitride is present in the sheet thickness center. Grain growth inhibiting capability cannot be obtained in the center portion of the steel sheet in such a case, which is not a suitable state for a grain-oriented electrical steel sheet.

We then considered the following method and experimented with it: First, the steel sheet is nitrided at the temperature suitable for the precipitation of AlN, to promote the precipitation of AlN near the surface of the steel sheet. After this, the temperature is decreased to the temperature suitable for the precipitation of $Si_3N_4$, and the steel sheet is further nitrided.

As a result, we discovered that, while AlN near the surface of the steel sheet remains in the precipitated state after the nitriding, $Si_3N_4$ precipitated by the succeeding nitriding undergoes a process of dissolving once and being substituted by AlN during heating in the subsequent secondary recrystallization annealing. We also discovered that this process in which $Si_3N_4$ dissolves once and is substituted by AlN contributes effectively to the precipitation of AlN around the sheet thickness center of the steel sheet.

The disclosure is based on the aforementioned discoveries and further studies.

We provide the following:

1. A method for manufacturing a grain-oriented electrical steel sheet including: hot rolling a steel slab to obtain a hot rolled sheet, the steel slab having a chemical composition containing (consisting of), in mass %: C: 0.10% or less; Si: 1.0% to 5.0%; Mn: 0.01% to 0.5%; one or two selected from S and Se: 0.002% to 0.040% in total; sol.Al 0.01% to 0.08%; and N: 0.0010% to 0.020%, with a balance being Fe and incidental impurities; hot band annealing the hot rolled sheet if required; cold rolling the hot rolled sheet once or twice or more with intermediate annealing in between, to obtain a cold rolled sheet having a final sheet thickness; and performing primary recrystallization annealing and nitriding treatment on the cold rolled sheet, and then applying an annealing separator and performing secondary recrystallization annealing to obtain a grain-oriented electrical steel sheet, wherein the nitriding treatment is performed in at least two stages of temperatures including high-temperature nitriding and low-temperature nitriding that follows the high-temperature nitriding, and a residence time in the high-temperature nitriding is 3 seconds or more and 600 seconds or less.

2. The method for manufacturing a grain-oriented electrical steel sheet according to the foregoing 1, wherein the chemical composition further contains, in mass %, one or more selected from: Ni: 0.005% to 1.50%; Sn: 0.01% to 0.50%; Sb: 0.005% to 0.50%; Cu: 0.01% to 0.50%; Cr: 0.01% to 1.50%; P: 0.0050% to 0.50%; Nb: 0.0005% to 0.0100%; Mo: 0.01% to 0.50%; Ti: 0.0005% to 0.0100%; B: 0.0001% to 0.0100%; and Bi: 0.0005% to 0.0100%.

3. The method for manufacturing a grain-oriented electrical steel sheet according to the foregoing 1 or 2, wherein the high-temperature nitriding is performed at 850° C. or more, and the low-temperature nitriding is performed at less than 850° C.

4. The method for manufacturing a grain-oriented electrical steel sheet according to any one of the foregoing 1 to 3, wherein in the primary recrystallization annealing, a heating rate between 500° C. and 700° C. is 50° C./s or more.

5. A nitriding apparatus used in the method for manufacturing a grain-oriented electrical steel sheet according to any one of the foregoing 1 to 4, the nitriding apparatus including: a nitriding gas supply pipe for introducing gas including at least ammonia or nitrogen; and a nitriding treatment portion for successively performing high-temperature nitriding and low-temperature nitriding in nitriding treatment, wherein the nitriding treatment portion includes a high-temperature treatment portion for performing the high-temperature nitriding and a low-temperature treatment portion for performing the low-temperature nitriding, and the nitriding gas supply pipe to the high-temperature treatment portion includes a cooling device.

6. The nitriding apparatus according to the foregoing 5, including a gas cooling zone between the high-temperature treatment portion and the low-temperature treatment portion.

7. The nitriding apparatus according to the foregoing 5 or 6, serving to adjust a temperature of the high-temperature treatment portion to 850° C. or more and a temperature of the low-temperature treatment portion to less than 850° C.

Advantageous Effect

By forming a large amount of AlN precipitate near the surface of the steel sheet first, it is possible to suppress degradation in steel sheet property caused by secondary recrystallization from the texture near the surface. Moreover, by forming a large amount of AlN precipitate near the surface of the steel sheet, it is possible to increase the precipitation of AlN around the sheet thickness center of the steel sheet. This allows suitable secondary recrystallization to develop around the sheet thickness center of the steel sheet. A grain-oriented electrical steel sheet having favorable property can thus be manufactured industrially stably.

DETAILED DESCRIPTION

Figure 1:
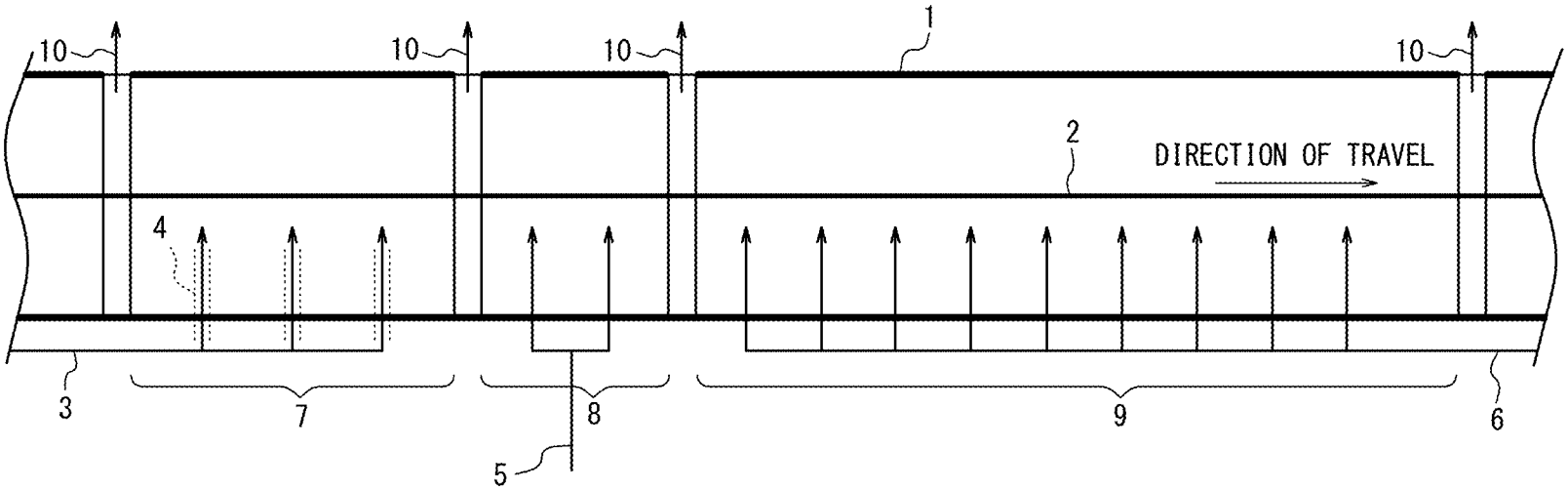
FIG. 1 is a diagram illustrating a suitable nitriding apparatus according to one of the disclosed embodiments.

Detailed description is given below.

The reasons for limiting the chemical composition of a steel slab are described first. In the following description, "%" denotes "mass %" unless otherwise noted.

C: 0.10% or less

C is an element useful in improving primary recrystallized texture. When the C content is more than 0.10%, however, the primary recrystallized texture degrades. The C content is therefore limited to 0.10% or less. The C content is desirably in the range of 0.01% to 0.08%, in terms of magnetic property. In the case where the required level of magnetic property is not so high, the C content may be 0.01% or less and 0.0005% or more in order to omit or simplify decarburization in primary recrystallization annealing.

Si: 1.0% to 5.0%

Si is an element useful in improving iron loss by increasing electrical resistance. When the Si content is more than 5.0%, however, cold rolling manufacturability decreases significantly. The Si content is therefore limited to 5.0% or less. Since Si is required to function as a nitride forming element, the Si content needs to be 1.0% or more. The Si content is desirably in the range of 1.5% to 4.5%, in terms of both iron loss property and cold rolling manufacturability.

Mn: 0.01% to 0.5%

Mn has an effect of improving hot workability during manufacture. When the Mn content is 0.01% or less, its effect is insufficient. When the Mn content is more than 0.5%, the primary recrystallized texture deteriorates and leads to lower magnetic property. The Mn content is therefore limited to 0.5% or less.

One or two selected from S and Se: 0.002% to 0.040% in total

S and Se are each a useful element that combines with Mn or Cu to form MnSe, MnS, $Cu_{2-x}Se$, or $Cu_{2-x}S$ and thus exerts an inhibitor effect as a second dispersion phase in the steel. When the total content of S and Se is less than 0.002%, their effect is insufficient. When the total content of S and Se is more than 0.040%, not only dissolution during slab heating is incomplete, but also the product surface becomes defective. The total content of S and Se is therefore limited to the range of 0.002% to 0.040% whether they are added singly or in combination.

sol.Al: 0.01% to 0.08%

Al is a useful component that forms AlN in the steel and exerts an inhibitor effect as a second dispersion phase. When the Al content is less than 0.01%, a sufficient amount of precipitate cannot be ensured. When the Al content is more than 0.08%, AlN precipitates excessively after the steel sheet is nitrided. This makes the grain growth inhibiting capability too high, which hampers secondary recrystallization even when the steel sheet is annealed to high temperature.

N: 0.0010% to 0.020%

N is a component necessary to form AlN, as with Al. Nitrogen necessary as an inhibitor in secondary recrystallization can be supplied by nitriding in the subsequent step. When the N content is less than 0.0010%, however, crystal grain growth in the annealing step before the nitriding step is excessive, which may cause intergranular cracking in the cold rolling step or the like. When the N content is more than 0.020%, the steel sheet blisters or the like during slab heating. The N content is therefore limited to the range of 0.0010% to 0.020%.

In the case where AlN additionally formed as a result of the nitriding treatment is actively used as an inhibitor, it is preferable to control the sol.Al content to 0.01% or more and control the N content to less than 14/26.98 of sol.Al. This allows AlN to be newly precipitated by the nitriding.

While the essential components in the slab have been described above, the following elements may be contained as appropriate as components for improving the magnetic property industrially more stably. The balance in the steel slab is Fe and incidental impurities.

Regarding O as an incidental impurity, when the amount of O is 50 ppm or more, it causes an inclusion such as a coarse oxide, and hampers the rolling step. As a result, the primary recrystallized texture becomes non-uniform, or the formed inclusion itself degrades the magnetic property. Accordingly, the amount of O is desirably limited to less than 50 ppm.

Ni: 0.005% to 1.50%

Ni has a function of improving the magnetic property by enhancing the uniformity of the hot rolled sheet texture. To do so, the Ni content is preferably 0.005% or more. When the Ni content is more than 1.50%, secondary recrystallization is difficult, and the magnetic property degrades. Accordingly, the Ni content is desirably in the range of 0.005% to 1.50%.

Sn: 0.01% to 0.50%

Sn is a useful element that suppresses the nitriding or oxidation of the steel sheet during secondary recrystallization annealing and promotes the secondary recrystallization of crystal grains having favorable crystal orientation to improve the magnetic property. To do so, the Sn content is preferably 0.01% or more. When the Sn content is more than 0.50%, cold rolling manufacturability decreases. Accordingly, the Sn content is desirably in the range of 0.01% to 0.50%.

Sb: 0.005% to 0.50%

Sb is a useful element that suppresses the nitriding or oxidation of the steel sheet during secondary recrystallization annealing and promotes the secondary recrystallization of crystal grains having favorable crystal orientation to effectively improve the magnetic property. To do so, the Sb content is preferably 0.005% or more. When the Sb content is more than 0.50%, cold rolling manufacturability decreases. Accordingly, the Sb content is desirably in the range of 0.005% to 0.50%.

Cu: 0.01% to 0.50%

Cu has a function of suppressing the oxidation of the steel sheet during secondary recrystallization annealing and promoting the secondary recrystallization of crystal grains having favorable crystal orientation to effectively improve the magnetic property. To do so, the Cu content is preferably 0.01% or more. When the Cu content is more than 0.50%, hot rolling manufacturability decreases. Accordingly, the Cu content is desirably in the range of 0.01% to 0.50%.

Cr: 0.01% to 1.50%

Cr has a function of stabilizing the formation of a forsterite film. To do so, the Cr content is preferably 0.01% or more. When the Cr content is more than 1.50%, secondary recrystallization is difficult, and the magnetic property degrades. Accordingly, the Cr content is desirably in the range of 0.01% to 1.50%.

P: 0.0050% to 0.50%

P has a function of stabilizing the formation of a forsterite film. To do so, the P content is preferably 0.0050% or more. When the P content is more than 0.50%, cold rolling manufacturability decreases. Accordingly, the P content is desirably in the range of 0.0050% to 0.50%.

Nb: 0.0005% to 0.0100%, Mo: 0.01% to 0.50%

Nb and Mo each have an effect of suppressing a scab after hot rolling by, for example, suppressing cracking due to a temperature change during slab heating. When the Nb content and the Mo content are each less than the aforementioned lower limit, its scab suppression effect is low. When the Nb content and the Mo content are each more than the aforementioned upper limit, iron loss degradation results if Nb or Mo remains in the final product by forming, for example, a carbide or a nitride. Accordingly, the Nb content and the Mo content are each desirably in the aforementioned range.

Ti: 0.0005% to 0.0100%, B: 0.0001% to 0.0100%, Bi: 0.0005% to 0.0100%

These components may each have an effect of functioning as an auxiliary inhibitor and stabilizing secondary recrystallization, by forming a precipitate when nitrided, segregating, or the like. When the contents of these components are each less than the aforementioned lower limit, its effect as an auxiliary inhibitor is low. When the contents of these components are each more than the aforementioned upper limit, the formed precipitate may remain even after purification and cause magnetic property degradation, or embrittle grain boundaries and degrade bend property.

The following describes a manufacturing method according to one of the disclosed embodiments.

A steel slab adjusted to the aforementioned suitable chemical composition range is, after or without being reheated, hot rolled. In the case of reheating the slab, the reheating temperature is desirably about 1000° C. or more and 1300° C. or less. Since nitriding treatment is performed before secondary recrystallization annealing to reinforce the inhibitor in this embodiment, fine precipitate dispersion by complete dissolution in the hot rolling step is not necessarily required. Hence, ultrahigh-temperature slab heating exceeding 1300° C. is not suitable in this embodiment. It is, however, effective to increase the heating temperature to dissolve Al, N, Mn, S, and Se to some extent and disperse them during hot rolling so that the grain size will not be excessively coarsened in the annealing step before the nitriding. Besides, if the heating temperature is too low, the rolling temperature during hot rolling drops, which increases the rolling load and makes the rolling difficult. Accordingly, the reheating temperature is desirably 1000° C. or more.

Following this, the hot rolled sheet is hot band annealed if required, and then cold rolled once or twice or more with intermediate annealing in between, to obtain a final cold rolled sheet. The cold rolling may be performed at normal temperature. Alternatively, the cold rolling may be warm rolling with the steel sheet temperature being higher than normal temperature, e.g. about 250° C.

The final cold rolled sheet is further subjected to primary recrystallization annealing.

The aim of the primary recrystallization annealing is to cause the primary recrystallization of the cold rolled sheet having rolled microstructure to adjust it to an optimal primary recrystallized grain size for secondary recrystallization. For this aim, the annealing temperature in the primary recrystallization annealing is desirably about 800° C. or more and less than 950° C. The annealing atmosphere is preferably a wet hydrogen nitrogen atmosphere or a wet hydrogen argon atmosphere. Decarburization annealing may also be carried out by such an atmosphere.

In the primary recrystallization annealing, the heating rate between 500° C. and 700° C. is preferably 50° C./s or more in terms of improving the texture of the steel sheet. Annealing with such a heating rate enhances the amount of Goss orientation of the texture in the steel. As a result, the grain size after secondary recrystallization is reduced, with it being possible to improve the iron loss property of the steel sheet. The upper limit of the heating rate between 500° C. and 700° C. is not particularly limited, but is about 400° C./s in terms of apparatus.

In addition, the pertinent temperature range in the primary recrystallization annealing is the temperature range corresponding to the recovery of the texture, as the aim is to quickly heat the steel sheet in the temperature range corresponding to the recovery of the texture after the cold rolling and recrystallize the steel sheet microstructure.

The heating rate in this temperature range is preferably 50° C./s or more. When the heating rate is less than 50° C./s, the recovery of the texture in such temperature cannot be suppressed sufficiently.

These technical ideas are the same as those described in JP H7-62436 A and the like.

In this embodiment, nitriding treatment is performed during, following, or after the primary recrystallization annealing. Most importantly, nitriding treatment is performed at a temperature suitable for the precipitation of AlN, i.e. 850° C. or more, and then nitriding treatment is performed at a lower temperature suitable for the precipitation of $Si_3N_4$ or iron nitride, i.e. less than 850° C.

In the nitriding in this embodiment, high-temperature nitriding is performed first at the temperature suitable for the precipitation of AlN. In particular, by performing nitriding at 850° C. or more which is the temperature suitable for the precipitation of AlN, nitrogen supplied by the nitriding enters into the steel, and simultaneously precipitates as AlN. Here, since the precipitation of AlN occurs immediately after nitrogen enters into the steel, the precipitate forms only near the surface of the steel sheet. AlN is a thermodynamically stable nitride, so that the precipitation state is maintained even during the secondary recrystallization annealing and the grain growth near the surface is inhibited. After this, low-temperature nitriding is performed at the temperature suitable for the precipitation of $Si_3N_4$ or iron nitride. In particular, by performing nitriding at less than 850° C. which is the temperature suitable for the precipitation of $Si_3N_4$ or iron nitride, nitrogen supplied by the nitriding enters into the steel and simultaneously precipitates in the form of $Si_3N_4$ or the like. Such nitride is equally formed near the surface immediately after the nitriding, but is not as thermodynamically stable as AlN. Hence, the nitride is substituted by AlN during heating in the secondary recrystallization annealing. This results in such a state where AlN is dispersed through to the sheet thickness center.

By performing the nitriding treatment with heating pattern of two stages or more including high-temperature nitriding and low-temperature nitriding in this way, a state in which the amount of AlN precipitate is intentionally increased near the surface of the steel sheet is created to suppress secondary recrystallization from the texture near the surface. The magnetic property can be improved stably in this way. The upper limit of the temperature of high-temperature nitriding is not particularly limited, but is about 1050° C. in terms of technology. The lower limit of the temperature of low-temperature nitriding is not particularly limited, but is about 450° C. in terms of productivity.

The nitriding treatments at the respective temperatures may be performed in two or more separate steps to achieve the same advantageous effects. Performing soaking in each temperature range eases the control of the precipitation state. However, even when soaking (a state without any temperature change) is not performed, the advantageous effects can be achieved as long as the residence time in the corresponding temperature range is ensured.

It is essential to ensure a residence time of 3 seconds or more in the temperature range of 850° C. or more. In the temperature range of 850° C. or more, AlN, while precipitating, simultaneously undergoes Ostwald ripening and increases in precipitates size, and so the residence time is limited to 600 seconds or less. Meanwhile, nitriding in the temperature range of less than 850° C. is intended to obtain the grain growth inhibiting capability throughout the sheet thickness, and a residence time until the required nitriding quantity is obtained is necessary.

The nitriding quantity in the nitriding treatment ((the amount of nitrogen after nitriding)−(the amount of nitrogen contained in the slab)) is preferably in the range of 100 mass ppm to 500 mass ppm which is a typical range in nitriding technology for grain-oriented electrical steel sheets. When the nitriding quantity is 100 mass ppm or less, nitriding is insufficient for the precipitation of AlN. When the nitriding quantity is more than 500 mass ppm, the supply of nitrogen is excessive and a secondary recrystallization failure may occur.

In the nitriding treatment, reaction efficiency decreases with a decrease in temperature, so that the required residence time varies widely depending on the temperature. For example, when the treatment is performed at about 750° C. at which $Si_3N_4$ precipitates, the required nitriding quantity can be obtained in a residence time of 1 minutes or less. When the treatment is performed at a low temperature such as 450° C. at which iron nitride precipitates, on the other hand, the reaction rate is very low, and so at least several hours may be necessary to obtain the required nitriding quantity.

Applying the nitriding treatment following the primary recrystallization annealing is efficient because energy necessary to heat the steel sheet can be saved. While the same advantageous effects can be achieved even when the treatment is performed by a plurality of annealing operations from the high temperature side, performing the treatment by one operation further enhances energy efficiency.

The following describes a suitable nitriding apparatus in this embodiment.

FIG. 1 illustrates a suitable nitriding apparatus. In FIG. 1, reference sign 1 is a nitriding apparatus, 2 is a steel strip, 3 is a nitriding gas supply pipe including a cooling device, 4 is a cooling device, 5 is a cooling gas supply pipe, 6 is a nitriding gas supply pipe, 7 is a high-temperature nitriding treatment portion, 8 is a gas cooling zone, 9 is a low-temperature nitriding treatment portion, and 10 is an exhaust port.

The nitriding apparatus 1 does not require any complex structure, and only needs to have the apparatus length corresponding to the sheet passing rate of the steep strip 2, and to be a heat treatment apparatus including front and rear heaters capable of separate temperature controls and the predetermined exhaust port 10. The nitriding apparatus 1 includes a gas introduction portion with a nitriding gas supply pipe (3 and 6) for introducing gas including at least ammonia or nitrogen with which a nitriding atmosphere can be maintained, and a nitriding treatment portion (7 and 9) capable of high-temperature nitriding and low-temperature nitriding in the nitriding treatment.

In this embodiment, high-temperature nitriding is performed first. Here, gas such as ammonia which is typically known as gas having nitriding ability is susceptible to high-temperature decomposition. If decomposed, the gas such as ammonia loses nitriding ability. In other words, if the gas changes in property in the gas supply pipe to the nitriding furnace, the nitriding efficiency of the gas decreases significantly. Accordingly, it is important to provide the nitriding gas supply pipe 3 including the cooling device 4 having cooling function in the high-temperature treatment portion 7 for high-temperature nitriding (the front half of the nitriding apparatus), in order to prevent the property change of the gas. The cooling device may be a cooling device typically used for gas cooling, such as a cooling device with a nozzle for blowing nitriding gas or inert gas of 400° C. or less onto the steel sheet.

Regarding the other parts, the following structures can be used to realize more effective nitriding treatment.

For example, the low-temperature treatment portion 9 for low-temperature nitriding (the rear half of the apparatus) may utilize natural cooling as long as heat insulation is sufficient. In the case where the uniformity of temperature cannot be maintained isothermally, however, the nitriding control level drops significantly. In such a case, it is preferable to use a heater capable of soaking the steel sheet at a slightly lower temperature or suppressing a decrease in temperature of the steel sheet. Moreover, the nitriding apparatus 1 desirably has a function of adjusting the temperature of the high-temperature treatment portion to 850° C. or more and adjusting the temperature of the low-temperature treatment portion to less than 850° C.

In the case of a single apparatus, the cooling zone 8 for cooling the steel strip 2 by the introduction of cooling gas from the cooling gas supply pipe 5 is preferably provided between the high-temperature treatment portion and the low-temperature treatment portion, to shorten the apparatus length. Such an apparatus can cool the steel strip 2 to an appropriate temperature in a short time while performing separate temperature adjustments in the front and rear of the furnace.

The gas introduced from the gas introduction portion is not limited as long as it is a gas typically used for nitriding such as $NH_3$ in electrical steel sheet manufacture. An oxynitriding atmosphere in which $O_2$ is slightly added to $NH_3$, a softnitriding atmosphere in which a slight amount of C is contained, or the like is also applicable. The gas used in the cooling zone is, for example, inert gas such as $N_2$ or Ar or the aforementioned nitriding gas.

Figure 2:
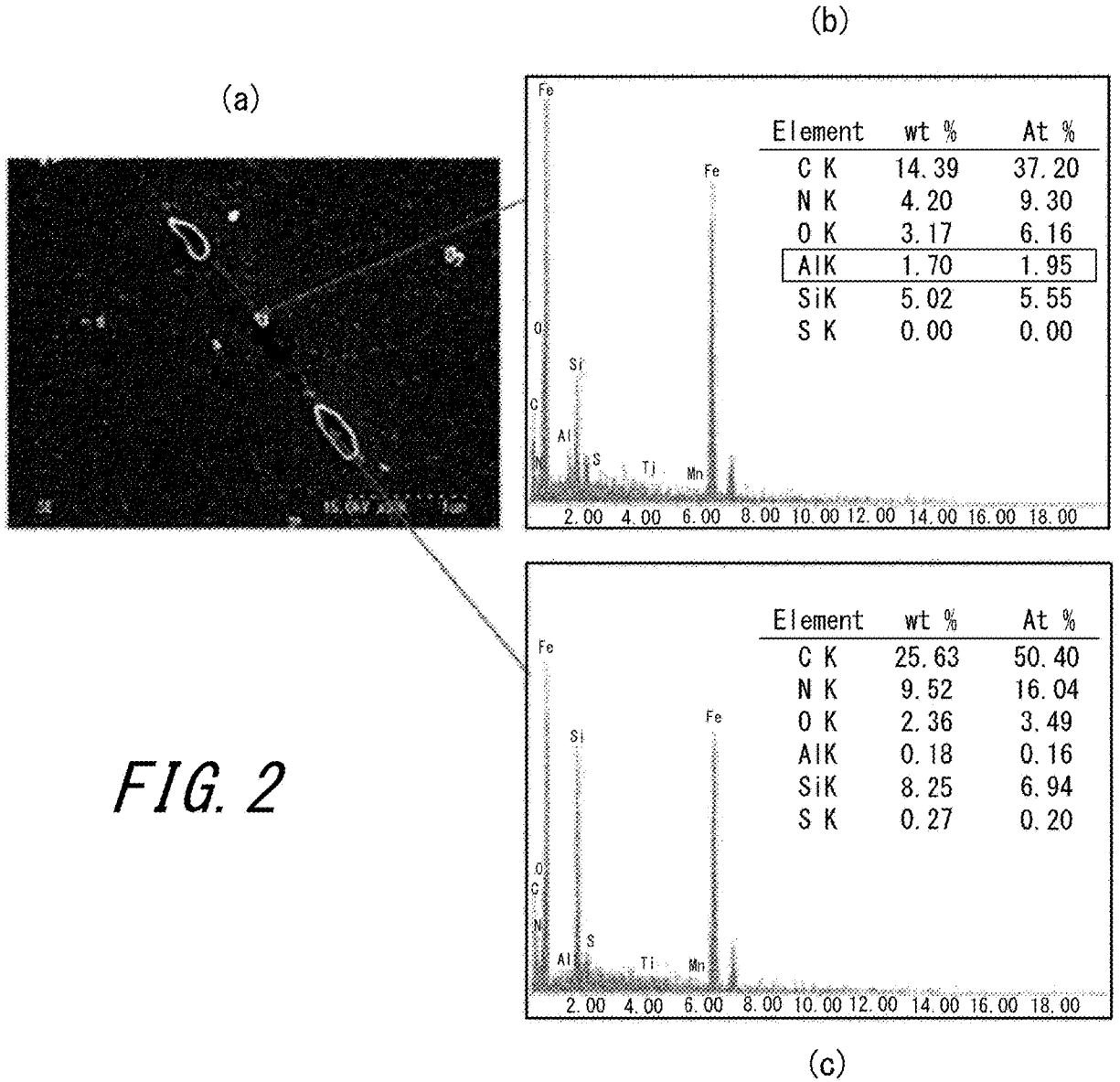
FIG. 2 (*a*) is a photograph of an SEM observation image of a section of a nitrided steel sheet formed under condition 3 in Examples, taken along the direction orthogonal to the rolling direction, and (b) and (c) are each a graph illustrating the result of analyzing texture in a designated part of the SEM observation image by energy-dispersive X-ray analysis (EDX).

FIG. 2 illustrates a SEM image obtained by SEM observation on a section of a nitrided steel sheet formed under condition 3 in the below-mentioned Examples, taken along the direction orthogonal to the rolling direction. As is clear from FIG. 2, MN and $Si_3N_4$ have precipitated in grain boundaries or in grains near the surface after nitriding treatment. In the case of condition 12 in which nitriding treatment is performed at a lower temperature, on the other hand, not $Si_3N_4$ but iron nitride has formed near the surface.

Thus, when high-temperature nitriding and then low-temperature nitriding are performed in the nitriding atmosphere of the nitriding treatment, a non-uniform precipitation state can be intentionally formed in the sheet thickness direction, with it being possible to enhance the grain growth inhibiting capability near the surface of the steel sheet.

An annealing separator is applied to the surface of the steel sheet after the aforementioned primary recrystallization annealing and nitriding treatment. To form a forsterite film on the surface of the steel sheet after the secondary recrystallization annealing, the main agent of the annealing separator needs to be magnesia (MgO). In the case where the formation of a forsterite film is unnecessary, on the other hand, the main agent of the annealing separator may be an appropriate oxide whose melting point is higher than the secondary recrystallization annealing temperature, such as alumina ($Al_2O_3$) or calcia (CaO).

One or more selected from sulfates and sulfides of Ag, Al, Ba, Ca, Co, Cr, Cu, Fe, In, K, Li, Mg, Mn, Na, Ni, Sn, Sb, Sr, Zn, and Zr may be added to the annealing separator as sulfate and/or sulfide. The content of the sulfate and/or sulfide in the annealing separator is preferably about 0.2% or more and 15% or less. When the sulfate and/or sulfide content is in this range, sulfur enters into the steel by the separator during secondary recrystallization, thus reinforcing the grain growth inhibition especially near the surface of the steel sheet. When the sulfate and/or sulfide content is less than 0.2%, the sulfur increase amount in the steel matrix is small. When the sulfate and/or sulfide content is more than 15%, the sulfur increase amount in the steel matrix is excessive. In either case, the magnetic property improving effect is low.

Following this, secondary recrystallization annealing is performed. In the heating process of the secondary recrystallization annealing, iron nitride decomposes and N diffuses in the steel. As the annealing atmosphere, $N_2$, Ar, $H_2$, or any mixture thereof is applicable.

The grain-oriented electrical steel sheet manufactured by the aforementioned steps from the grain-oriented electrical steel sheet slab has the following features. In the heating process of the secondary recrystallization annealing before the start of secondary recrystallization, the amount of nitride present near the surface of the steel sheet is increased, and also nitride is precipitated through to the sheet thickness center. As a result, favorable magnetic property can be obtained by effectively suppressing secondary recrystallization from the surface that tends to have inferior texture.

After the secondary recrystallization annealing, an insulating coating may be applied to the surface of the steel sheet and baked. The type of the insulating coating is not particularly limited, and may be any conventionally well-known insulating coating. For example, a method of applying an application liquid containing phosphate-chromate-colloidal silica described in JP S50-79442 A and JP S48-39338 A to the steel sheet and baking it at about 800° C. is suitable.

Moreover, flattening annealing may be performed to arrange the shape of the steel sheet. This flattening annealing may also serve as the insulating coating baking treatment.

EXAMPLES

Each type of grain-oriented electrical steel sheet slab shown in Table 1 was heated at 1230° C., hot rolled into a hot rolled sheet of 2.5 mm in sheet thickness, and then hot band annealed at 1050° C. for 1 minute. After this, the sheet was cold rolled to a final sheet thickness of 0.27 mm. A sample of 100 mm×400 mm in size was collected from the center portion of the obtained cold rolled coil, and subjected to annealing serving as both primary recrystallization and decarburization in a laboratory.

Following this, nitriding treatment was performed under the nitriding condition shown in Table 1, in a mixed atmosphere of ammonia, hydrogen, and nitrogen. In the primary recrystallization annealing, the heating rate between 500° C. and 700° C. was any of two levels of 20° C./s and 150° C./s.

Moreover, 21 or 20 steel sheets of the same condition were produced per condition. In each condition for which 21 steel sheets were produced, one of the steel sheets was used for the analysis of the nitrided sample. For the remaining 20 steel sheets, an annealing separator mainly containing MgO, to which the annealing separation additive shown in Table 1 was added in an aqueous slurry state, was applied and dried, and baked on the steel sheet. Subsequently, final annealing with a maximum temperature of 1200° C. was performed to cause secondary recrystallization. Following this, a phosphate-based insulating tension coating was applied and baked, and the magnetic flux density ($B_8$, T) with a magnetizing force of 800 A/m and the iron loss ($W_{17/50}$, W/kg) with 50 Hz and an excitation magnetic flux density of 1.7 T were evaluated. As the magnetic property, the magnetic flux density was evaluated based on the average value and minimum value of 20 steel sheets in each condition, and the iron loss was evaluated based on the average value of 20 steel sheets in each condition.

The evaluation results are shown in Table 1.

TABLE 1

| Condition | Slab component (%) Si | C | Mn | S | Se | sol. Al | N | Others | Heating rate in primary recrystallization between 500° C. and 700° C. | Nitriding treatment condition High-temperature nitriding | Low-temperature nitriding |
|---|---|---|---|---|---|---|---|---|---|---|---|
| 1 | 3.40 | 0.06 | 0.02 | 0.001 | 0.010 | 0.020 | 0.004 | N/A | 20° C./s | N/A | N/A |
| 2 | 3.40 | 0.06 | 0.02 | 0.001 | 0.010 | 0.020 | 0.004 | N/A | 20° C./s | N/A | 750° C. × 30 sec |
| 3 | 3.40 | 0.06 | 0.02 | 0.001 | 0.010 | 0.020 | 0.004 | N/A | 20° C./s | 900° C. × 2 sec | 750° C. × 30 sec |
| 4 | 3.40 | 0.06 | 0.02 | 0.001 | 0.010 | 0.020 | 0.004 | N/A | 20° C./s | 900° C. × 10 sec | 750° C. × 30 sec |
| 5 | 3.40 | 0.06 | 0.02 | 0.001 | 0.010 | 0.020 | 0.004 | N/A | 20° C./s | 900° C. × 60 sec | 750° C. × 30 sec |
| 6 | 3.40 | 0.06 | 0.02 | 0.001 | 0.010 | 0.020 | 0.004 | N/A | 20° C./s | 860° C. × 90 sec | 750° C. × 30 sec |
| 7 | 3.40 | 0.06 | 0.02 | 0.001 | 0.010 | 0.020 | 0.004 | N/A | 20° C./s | 860° C. × 720 sec | 750° C. × 30 sec |
| 8 | 3.15 | 0.04 | 0.04 | 0.010 | Tr. | 0.015 | 0.007 | N/A | 20° C./s | N/A | N/A |
| 9 | 3.15 | 0.04 | 0.04 | 0.010 | Tr. | 0.015 | 0.007 | N/A | 20° C./s | N/A | 750° C. × 30 sec |
| 10 | 3.15 | 0.04 | 0.04 | 0.010 | Tr. | 0.015 | 0.007 | N/A | 150° C./s | 950° C. × 5 sec | 750° C. × 30 sec |
| 11 | 3.15 | 0.04 | 0.04 | 0.010 | Tr. | 0.015 | 0.007 | N/A | 20° C./s | 950° C. × 5 sec | 750° C. × 30 sec |
| 12 | 3.15 | 0.04 | 0.04 | 0.010 | Tr. | 0.015 | 0.007 | N/A | 20° C./s | 950° C. × 5 sec | 480° C. × 1200 sec |
| 13 | 3.20 | 0.04 | 0.05 | 0.004 | 0.005 | 0.023 | 0.006 | Ni: 0.03, Sn: 0.02 | 20° C./s | 900° C. × 10 sec | 750° C. × 30 sec |
| 14 | 3.20 | 0.04 | 0.05 | 0.004 | 0.006 | 0.022 | 0.005 | Sb: 0.03, Mo: 0.03 | 20° C./s | 900° C. × 10 sec | 750° C. × 30 sec |
| 15 | 3.15 | 0.04 | 0.05 | 0.003 | 0.006 | 0.024 | 0.005 | P: 0.02, B: 0.0005 | 20° C./s | 900° C. × 10 sec | 750° C. × 30 sec |
| 16 | 3.10 | 0.04 | 0.05 | 0.004 | 0.004 | 0.022 | 0.006 | Nb: 0.001, P: 0.01 | 150° C./s | 900° C. × 10 sec | 750° C. × 30 sec |
| 17 | 3.15 | 0.04 | 0.05 | 0.003 | 0.004 | 0.023 | 0.005 | Bi: 0.001 | 150° C./s | 900° C. × 10 sec | 750° C. × 30 sec |
| 18 | 3.15 | 0.04 | 0.05 | 0.005 | 0.005 | 0.025 | 0.005 | Cu: 0.03 | 150° C./s | 900° C. × 10 sec | 750° C. × 30 sec |
| 19 | 3.10 | 0.04 | 0.05 | 0.004 | 0.006 | 0.024 | 0.006 | Cr: 0.02, Ti: 0.002 | 150° C./s | 900° C. × 10 sec | 750° C. × 30 sec |

| Condition | Annealing separator additive | Magnetic property $B_8$ (T) average | minimum | Magnetic property $W_{17/50}$ average (W/kg) | Remarks |
|---|---|---|---|---|---|
| 1 | $TiO_2$ | 1.89 | 1.87 | 1.03 | Comparative Example |
| 2 | $TiO_2$ | 1.92 | 1.90 | 0.96 | Comparative Example |
| 3 | $TiO_2$ | 1.92 | 1.90 | 0.96 | Comparative Example |
| 4 | $TiO_2$ | 1.93 | 1.92 | 0.96 | Example |
| 5 | $TiO_2$ | 1.92 | 1.91 | 0.96 | Example |
| 6 | $TiO_2$ | 1.92 | 1.92 | 0.96 | Example |
| 7 | $TiO_2$ | 1.91 | 1.90 | 1.00 | Comparative Example |
| 8 | $TiO_2$ | 1.89 | 1.86 | 1.04 | Comparative Example |
| 9 | $TiO_2$ | 1.92 | 1.90 | 0.98 | Comparative Example |
| 10 | $TiO_2$ | 1.92 | 1.91 | 0.93 | Example |
| 11 | $MgSO_4$ | 1.93 | 1.92 | 0.97 | Example |
| 12 | $TiO_2$ | 1.93 | 1.91 | 0.96 | Example |
| 13 | $TiO_2$ | 1.93 | 1.92 | 0.96 | Example |
| 14 | $MgSO_4$ | 1.93 | 1.92 | 0.96 | Example |
| 15 | $MgSO_4$ | 1.93 | 1.92 | 0.94 | Example |
| 16 | MgS | 1.93 | 1.92 | 0.90 | Example |
| 17 | MgS | 1.94 | 1.92 | 0.90 | Example |
| 18 | $TiO_2$ | 1.93 | 1.92 | 0.91 | Example |
| 19 | $TiO_2$ | 1.93 | 1.92 | 0.91 | Example |

As shown in Table 1, in Examples, the minimum value of $B_8$ improved as compared with Comparative Examples. The average value of $B_8$ also improved to some extent. In the case where S was contained in the annealing separator, the magnetic flux density was a little higher. Moreover, each raw material with a higher heating rate in primary recrystallization had excellent iron loss property.

REFERENCE SIGNS LIST

1 nitriding apparatus
2 steel strip
3 nitriding gas supply pipe including cooling device
4 cooling device
5 cooling gas supply pipe
6 nitriding gas supply pipe
7 high-temperature nitriding treatment portion
8 gas cooling zone
9 low-temperature nitriding treatment portion
10 exhaust port

The invention claimed is:

1. A method for manufacturing a grain-oriented electrical steel sheet comprising:

hot rolling a steel slab to obtain a hot rolled sheet, the steel slab having a chemical composition containing, in mass %: C: 0.10% or less; Si: 1.0% to 5.0%; Mn: 0.01% to 0.5%; one or two selected from S and Se: 0.002% to 0.040% in total; sol.Al: 0.01% to 0.08%; and N: 0.0010% to 0.020%, with a balance being Fe and incidental impurities;

hot band annealing the hot rolled sheet;

cold rolling the hot rolled sheet once or twice or more with intermediate annealing in between, to obtain a cold rolled sheet having a final sheet thickness;

performing primary recrystallization annealing and nitriding treatment on the cold rolled sheet, wherein the nitriding treatment is performed following the primary recrystallization annealing, the nitriding treatment consisting of a high-temperature nitriding and a low-temperature nitriding that follows the high-temperature nitriding, and wherein the high-temperature nitriding is performed at 860° C. or more for a residence time of 3 seconds or more and 600 seconds or less in an atmosphere containing ammonia, and the low-temperature nitriding is performed at 750° C. or less in an atmosphere containing ammonia; and then applying an annealing separator and performing secondary recrystallization annealing to obtain a grain-oriented electrical steel sheet.

2. The method for manufacturing a grain-oriented electrical steel sheet according to claim 1, wherein the chemical composition further contains, in mass %, one or more selected from:

Ni: 0.005% to 1.50%;
Sn: 0.01% to 0.50%;
Sb: 0.005% to 0.50%;
Cu: 0.01% to 0.50%;
Cr: 0.01% to 1.50%;
P: 0.0050% to 0.50%;
Nb: 0.0005% to 0.0100%;
Mo: 0.01% to 0.50%;
Ti: 0.0005% to 0.0100%;
B: 0.0001% to 0.0100%; and
Bi: 0.0005% to 0.0100%.

3. The method for manufacturing a grain-oriented electrical steel sheet according to claim 1, wherein the high-temperature nitriding is performed in a range of 860° C. to 950° C., and the low-temperature nitriding is performed in a range of 480° C. to 750° C.

4. The method for manufacturing a grain-oriented electrical steel sheet according to claim 1, wherein in the primary recrystallization annealing, a heating rate between 500° C. and 700° C. is 50° C./s or more.

5. The method for manufacturing a grain-oriented electrical steel sheet according to claim 2, wherein the high-temperature nitriding is performed in a range of 860° C. to 950° C., and the low-temperature nitriding is performed in a range of 480° C. to 750° C.

6. The method for manufacturing a grain-oriented electrical steel sheet according to claim 2, wherein in the primary recrystallization annealing, a heating rate between 500° C. and 700° C. is 50° C./s or more.

7. The method for manufacturing a grain-oriented electrical steel sheet according to claim 3, wherein in the primary recrystallization annealing, a heating rate between 500° C. and 700° C. is 50° C./s or more.

8. The method for manufacturing a grain-oriented electrical steel sheet according to claim 5, wherein in the primary recrystallization annealing, a heating rate between 500° C. and 700° C. is 50° C./s or more.

* * * * *